US006402860B2

(12) United States Patent
Hashikura et al.

(10) Patent No.: US 6,402,860 B2
(45) Date of Patent: Jun. 11, 2002

(54) ALUMINUM ALLOY AND METHOD FOR MANUFACTURING ALUMINUM-ALLOY MEMBER

(75) Inventors: Manabu Hashikura; Hisao Hattori; Toshihiko Kaji; Yoshinobu Takeda, all of Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/428,480

(22) Filed: Oct. 28, 1999

(30) Foreign Application Priority Data

Oct. 30, 1998 (JP) ..... 10-311236

(51) Int. Cl.[7] ..... C22C 21/00; C22C 1/04
(52) U.S. Cl. ..... 148/440; 420/543
(58) Field of Search ..... 420/528, 543; 148/440; 428/472.2

(56) References Cited

U.S. PATENT DOCUMENTS

| | | | | |
|---|---|---|---|---|
| 3,278,300 A | | 10/1966 | Kichizo et al. | |
| 5,405,462 A | * | 4/1995 | Masumoto et al. | 148/564 |
| 5,417,919 A | * | 5/1995 | Ohori et al. | 420/532 |
| 5,578,144 A | * | 11/1996 | Satou et al. | 148/415 |
| 5,647,919 A | * | 7/1997 | Kita et al. | 148/437 |

FOREIGN PATENT DOCUMENTS

| | | |
|---|---|---|
| EP | 0 529 542 A1 | 3/1993 |
| EP | 0 534 470 A1 | 3/1993 |
| EP | 0 558 977 A2 | 9/1993 |
| EP | 0 610 006 A1 | 8/1994 |
| FR | 1521857 | 4/1968 |
| JP | 62-238345 | 10/1987 |
| JP | 1-272739 | 10/1989 |
| JP | 1/272740 | 10/1989 |
| JP | 1-275732 | 11/1989 |
| JP | 1-316433 | 12/1989 |
| JP | 5-239583 | 9/1993 |
| JP | 6-184712 | 7/1994 |
| JP | 11-236601 | 8/1999 |

OTHER PUBLICATIONS

Callister, William D. Jr, Materials Science and Engineering: An Introduction, 3rd Ed. pp. 131, 133, 1994.*

* cited by examiner

*Primary Examiner*—Roy King
*Assistant Examiner*—Janelle Combs-Morillo
(74) *Attorney, Agent, or Firm*—McDermott, Will & Emery

(57) ABSTRACT

The invention offers an aluminum alloy that not only has high hardness accompanied by balanced ductility but also has high toughness and superior processability. The invention also offers a method for manufacturing an aluminum-alloy member that not only has high hardness accompanied by balanced ductility but also has high toughness and superior processability. The aluminum alloy comprises (1) not less than 0.1 wt. % and not more than 8 wt. % Constituent A comprising one or more kinds of elements selected from the group consisting of titanium, vanadium, hafnium, and zirconium, (2) not less than 0.1 wt. % and not more than 20 wt. % Constituent B comprising one or more kinds of elements selected from the group consisting of lanthanum, cerium, praseodymium, neodymium, mischmetal, calcium, strontium, and barium, and (3) not less than 0.1 wt. % and not more than 20 wt. % Constituent C comprising one or more kinds of elements selected from the group consisting of magnesium and lithium.

12 Claims, No Drawings

ALUMINUM ALLOY AND METHOD FOR MANUFACTURING ALUMINUM-ALLOY MEMBER

BACKGROUND OF THE INVENTION

1. Field of the Invention

The present invention relates to an aluminum alloy and a method for manufacturing an aluminum-alloy member and, more particularly, to an aluminum alloy combining good forgeability and high hardness and a method for manufacturing an aluminum-alloy member combining good forgeability and high hardness.

2. Description of the Background Art

High-strength aluminum alloys have been in use in recent years that are produced by adopting a rapid solidification technique.

For instance, a published Japanese patent application Tokukaihei 1-275732 has disclosed that rapid solidification of a multi-element alloy expressed by a general formula $A_aM_bX_c$ produces a nanocrystalline aluminum alloy having such mechanical properties as a tensile strength of 853 to 1,009 MPa, a yield strength of 804 to 941 MPa, and a hardness HV of 200 to 1,000. In the above formula $Al_aM_bX_c$, (1) "M" means one or more kinds of metal elements selected from the group consisting of chrome(Cr), manganese(Mn), iron(Fe), cobalt(Co), nickel(Ni), copper (Cu), zirconium(Zr), titanium(Ti), magnesium(Mg), and silicon(Si), (2) "X" means one or more kinds of metal elements selected from the group consisting of yttrium(Y), lanthanum(La), cerium(Ce), samarium(Sm), neodymium (Nd), niobium(Nb), and mischmetal(Mm), and (3) "a", "b", and "c" mean an atomic percent, "a" lying in the range of 50 to 95 atm. %, "b" in the range of 0.5 to 35 atm. %, and "c" 0.5 to 25 atm. %.

Another published Japanese patent application Tokukaihei 6-184712 has disclosed an aluminum alloy having the composition expressed by a general formula $Al_aLn_bM_c$, where (1) "Ln" means one or more kinds of metal elements selected from the group consisting of mischmetal, yttrium, lanthanum, cerium, samarium, neodymium, hafnium, niobium, and tantalum, (2) "M" means one or more kinds of metal elements selected from the group consisting of vanadium, chrome, manganese, iron, cobalt, nickel, copper, zirconium, titanium, molybdenum, tungsten, calcium, lithium, magnesium, and silicon, and (3) "a", "b", and "c" mean an atomic percent, "a" lying in the range of 50 to 97.5 atm. %, "b" in the range of 0.5 to 30 atm. %, and "c" 0.5 to 30 atm. %. The aluminum alloy is a rapidly solidified aluminum alloy that has a cellular composite structure in which 5 to 50 vol. % amorphous phases surround nanocrystalline phases. The aluminum alloy is subjected to plastic working at a temperature higher than the crystallization temperature of the amorphous phase. Intermetallic compounds comprising two or more kinds of the above-described Al, "Ln", and "M" are dispersed in the nanocrystalline matrix to form a structure having such mechanical properties as a tensile strength of 760 to 890 MPa and an elongation of 5.5 to 9.0%.

However, the aluminum alloy disclosed in the application Tokukaihei 1-275732 has poor ductility and toughness, though it has very high tensile strength and hardness. Because this lack of sufficient ductility and toughness allows easy generation of cracks at the time of processing such as forging and upsetting, it is difficult to perform near-net-shape forging with complicated shapes.

When forging is carried out by exploiting its superplasticity resulting from its nanocrystallinity, it is possible to impart complicated shapes. However, its poor ductility and toughness requires prolonged time for a single step of forging, causing a problem of reduced production efficiency, and hence an increase in manufacturing costs. Such a problem becomes serious when forming ornamental components that require complicated, fine shapes such as embossed letters on the surface.

Although the aluminum alloy disclosed in the application Tokukaihei 6-184712 ensures a certain amount of ductility, it does not have sufficient mechanical properties to undergo near-net-shape forging with complicated shapes. In addition to that, because it uses material powders in which amorphous layers are formed, there is a problem of increased material cost.

SUMMARY OF THE INVENTION

The present invention is aimed at solving the above-described problems. An object of the present invention is to offer an aluminum alloy that not only has high hardness accompanied by balanced ductility but also has high toughness and superior processability.

Another object of the present invention is to offer a method for manufacturing an aluminum-alloy member that not only has high hardness accompanied by balanced ductility but also has high toughness and superior processability.

The first aspect of the present invention offers an aluminum alloy that comprises (1) not less than 0.1 wt. % and not more than 8 wt. % Constituent A comprising one or more kinds of elements selected from the group consisting of titanium (Ti), vanadium (V), hafnium (Hf), and zirconium (Zr), (2) not less than 0.1 wt. % and not more than 20 wt. % Constituent B comprising one or more kinds of elements selected from the group consisting of lanthanum (La), cerium (Ce), praseodymium (Pr), neodymium (Nd), mischmetal (Mm), calcium (Ca), strontium (St), and barium (Ba), and (3) not less than 0.1 wt. % and not more than 20 wt. % Constituent C comprising one or more kinds of elements selected from the group consisting of magnesium (Mg) and lithium (Li).

The second aspect of the present invention offers another aluminum alloy that comprises (1) not less than 0.1 wt. % and not more than 5 wt. % Constituent D comprising one or more kinds of elements selected from the group consisting of niobium (Nb), molybdenum (Mo), silver (Ag), iron (Fe), cobalt (Co), tantalum (Ta), and tungsten (W), (2) not less than 0.1 wt. % and not more than 20 wt. % Constituent B comprising one or more kinds of elements selected from the group consisting of lanthanum (La), cerium (Ce), praseodymium (Pr), neodymium (Nd), mischmetal (Mm), calcium (Ca), strontium (St), and barium (Ba), and (3) not less than 0.1 wt. % and not more than 20 wt. % Constituent C comprising one or more kinds of elements selected from the group consisting of magnesium (Mg) and lithium (Li).

The third aspect of the present invention offers a method for manufacturing an aluminum-alloy member made of the following aluminum alloy: The aluminum alloy comprises (1) not less than 0.1 wt. % and not more than 8 wt. % Constituent A comprising one or more kinds of elements selected from the group consisting of titanium (Ti), vanadium (V), hafnium (Hf), and zirconium (Zr), (2) not less than 0.1 wt. % and not more than 20 wt. % Constituent B comprising one or more kinds of elements selected from the group consisting of lanthanum (La), cerium (Ce), praseodymium (Pr), neodymium (Nd), mischmetal (Mm), calcium (Ca), strontium (St), and barium (Ba), and (3) not less than 0.1 wt. % and not more than 20 wt. % Constituent C comprising one or more kinds of elements selected from the group consisting of magnesium (Mg) and lithium (Li). First, a preform comprising the aluminum alloy is produced. Next, the preform is heated up to a temperature not lower than 200° C. and not higher than 600° C. at a temperature rising rate of not less than 2° C./sec and not more than 200° C./sec. Then, the heated preform is subjected to hot-working.

The fourth aspect of the present invention offers a method for manufacturing an aluminum-alloy member made of the following aluminum alloy: The aluminum alloy comprises (1) not less than 0.1 wt. % and not more than 5 wt. % Constituent D comprising one or more kinds of elements selected from the group consisting of niobium (Nb), molybdenum (Mo), silver (Ag), iron (Fe), cobalt (Co), tantalum (Ta), and tungsten (W), (2) not less than 0.1 wt. % and not more than 20 wt. % Constituent B comprising one or more kinds of elements selected from the group consisting of lanthanum (La), cerium (Ce), praseodymium (Pr), neodymium (Nd), mischmetal (Mm), calcium (Ca), strontium (St), and barium (Ba), and (3) not less than 0.1 wt. % and not more than 20 wt. % Constituent C comprising one or more kinds of elements selected from the group consisting of magnesium (Mg) and lithium (Li). First, a preform comprising the aluminum alloy is produced. Next, the preform is heated up to a temperature not lower than 200° C. and not higher than 600° C. at a temperature rising rate of not less than 2° C./sec and not more than 200° C./sec. Then, the heated preform is subjected to hot-working.

The first to fourth aspects of the present invention offer an aluminum alloy that not only has high hardness accompanied by balanced ductility but also has high toughness and superior processability and a method for manufacturing an aluminum-alloy member that not only has high hardness accompanied by balanced ductility but also has high toughness and superior processability.

DETAILED DESCRIPTION OF THE INVENTION

The first aspect of the present invention offers an aluminum alloy that comprises (1) not less than 0.1 wt. % and not more than 8 wt. % Constituent A comprising one or more kinds of elements selected from the group consisting of titanium (Ti), vanadium (V), hafnium (Hf), and zirconium (Zr), (2) not less than 0.1 wt. % and not more than 20 wt. % Constituent B comprising one or more kinds of elements selected from the group consisting of lanthanum (La), cerium (Ce), praseodymium (Pr), neodymium (Nd), mischmetal (Mm), calcium (Ca), strontium (St), and barium (Ba), and (3) not less than 0.1 wt. % and not more than 20 wt. % Constituent C comprising one or more kinds of elements selected from the group consisting of magnesium (Mg) and lithium (Li).

Such a composition facilitates the formation of complicated shapes because it reduces the strength of the aluminum alloy in the temperature range for processing. This reduces the number of times of forming (forging) until the last shape in comparison with the conventional products, and therefore reduces the processing cost.

This composition also increases the hardness of the aluminum alloy, and increased hardness suppresses the generation of surface flaws on members made of the aluminum alloy of the present invention during their manufacturing processes, reducing the fraction defective of the products.

The addition of a small amount of Ti, V, Hf, and Zr, which are used in Constituent A, can reduce the grain size of aluminum, increasing the hardness of the aluminum alloy. Intermetallic compounds between these elements and aluminum are deposited or crystallized out at the center of the individual crystal grains of aluminum (one place per crystal grain). If the content of Constituent A is less than 0.1 wt. %, the above-mentioned effect of increased hardness cannot be obtained. If the content of Constituent A is more than 8 wt. %, although the hardness of the aluminum alloy increases, the ductility, critical upsetting ratio, and other properties decrease, making it difficult to perform near-net-shape forging with complicated shapes, resulting in the reduction in forgeability.

The above-mentioned upsetting ratio is expressed in (L0–L1)/L0×100 (%), where L0 is the sample length in the upsetting direction before the upsetting work, and L1 after the upsetting work. The critical upsetting ratio is defined as the upsetting ratio at which cracks begin to develop at the periphery of the workpiece when upsetting is performed at a forging rate of 0.5 mm/sec. If the critical upsetting ratio is 70% or more, the sample is considered to have sufficient forgeability.

The elements La, Ce, Pr, Nd, Mm, Ca, Sr, and Ba, which are used in Constituent B, have an effect that a small amount of their addition can deposit a large amount of intermetallic compounds having high hardness. The deposition of intermetallic compounds increases the hardness of the aluminum alloy. The intermetallic compounds between these elements and aluminum are deposited or crystallized out at grain boundaries of aluminum. If the content of Constituent B is less than 0.1 wt. %, the above-mentioned effect cannot be obtained. If the content of Constituent B is more than 20 wt. %, although the hardness of the aluminum alloy increases, the ductility and other properties deteriorate, reducing the forgeability.

The elements Mg and Li, which are used in Constituent C, have an effect that they can increase the hardness of the aluminum alloy when they are rapidly solidified in α-aluminum to form a supersaturated solid solution. If the content of Constituent C is less than 0.1 wt. %, the above-mentioned effect cannot be obtained. If the content of Constituent C is more than 20 wt. %, although the hardness of the aluminum alloy increases, the ductility, critical upsetting ratio, and other properties deteriorate, reducing the forgeability.

When Constituents A, B, and C are added with the specified contents as shown above, because the aluminum having Constituent C as a solid solution has fine crystal grains and because the intermetallic compounds are deposited or crystallized out at grain boundaries, a structure is formed that has less tendency to overgrow with temperature. The formation of this structure enables the production of an aluminum alloy with superior balance between the hardness and forgeability.

If any one of Constituents A, B, and C lies beyond the specified range of content, the balance between the hardness and forgeability is destroyed, producing high hardness with low forgeability or high forgeability with low hardness.

When an aluminum alloy having the above-described structure is hot-worked and then its surface is polished by buffing or other means, the surface of the member made of this hot-worked aluminum alloy can easily obtain metallic luster.

In the aluminum alloy of the first aspect of the present invention, it is more desirable that the content of Constituent C be more than 5 wt. % and not more than 20 wt. %.

This content range, when the surface of the aluminum alloy is anodized to form an anodic oxide coating, enables the anodic oxide coating to obtain a shade of relatively low brightness such as brown or dark gray.

The shade of the anodic oxide coating can be changed by adjusting the kind and content of elements used in Constituent C and other Constituents.

The aluminum alloy of the first aspect of the present invention may further comprise not less than 0.1 wt. % and not more than 5 wt. % Constituent D comprising one or more kinds of elements selected from the group consisting of niobium (Nb), molybdenum (Mo), silver (Ag), iron (Fe), cobalt (Co), tantalum (Ta), and tungsten (W).

This can offer an aluminum alloy having good forgeablity and higher hardness.

The elements Nb, Mo, Ag, Fe, Co, Ta, and W, which are used in Constituent D, have an effect that they can not only reduce the grain size of aluminum but also deposit a large amount of intermetallic compounds. As a result, the hardness of the aluminum alloy can be further increased. In this case, the intermetallic compounds are deposited or crystallized out at a plurality of places inside the individual crystal grains of the aluminum.

If the content of Constituent D is less than 0.1 wt. %, the above-mentioned effect cannot be obtained. If the content of Constituent D is more than 5 wt. %, although the hardness of the aluminum alloy increases, the ductility, critical upsetting ratio, and other properties deteriorate, reducing the forgeability.

In the aluminum alloy of the first aspect of the present invention, it is more desirable that Constituent A be Zr, Constituent B be Mm, and Constituent C be Mg. In this case, it is more desirable that the content of Constituent A be not less than 0.1 wt. % and not more than 3 wt. % and the content of Constituent B be not less than 0.1 wt. % and not more than 15 wt. %.

The respective use of Zr, Mm, and Mg as Constituents A, B, and C can offer an aluminum alloy with further enhanced balance between the hardness and forgeability.

The second aspect of the present invention offers another aluminum alloy that comprises (1) not less than 0.1 wt. % and not more than 5 wt. % Constituent D comprising one or more kinds of elements selected from the group consisting of niobium (Nb), molybdenum (Mo), silver (Ag), iron (Fe), cobalt (Co), tantalum (Ta), and tungsten (W), (2) not less than 0.1 wt. % and not more than 20 wt. % Constituent B comprising one or more kinds of elements selected from the group consisting of lanthanum (La), cerium (Ce), praseodymium (Pr), neodymium (Nd), mischmetal (Mm), calcium (Ca), strontium (St), and barium (Ba), and (3) not less than 0.1 wt. % and not more than 20 wt. % Constituent C comprising one or more kinds of elements selected from the group consisting of magnesium (Mg) and lithium (Li).

Such a composition facilitates the formation of complicated shapes because it reduces the strength of the aluminum alloy in the temperature range for processing. This reduces the number of times of forming (forging) until the last shape in comparison with the conventional products, and therefore reduces the processing cost.

This composition also increases the hardness of the aluminum alloy. Increased hardness suppresses the generation of surface flaws on members made of the aluminum alloy of the present invention during their manufacturing processes, reducing the fraction defective of the products.

The elements Nb, Mo, Ag, Fe, Co, Ta, and W, which are used in Constituent D, have an effect that they can not only reduce the grain size of aluminum but also deposit a large amount of intermetallic compounds. As a result, the hardness of the aluminum alloy can be further increased. The intermetallic compounds produced by Constituent D are deposited or crystallized out at a plurality of places inside the individual crystal grains of the aluminum. If the content of Constituent D is less than 0.1 wt. %, the above-mentioned effect cannot be obtained. If the content of Constituent D is more than 5 wt. %, although the hardness of the aluminum alloy increases, the ductility, critical upsetting ratio, and other properties deteriorate, reducing the forgeability.

The elements La, Ce, Pr, Nd, Mm, Ca, Sr, and Ba, which are used in Constituent B, have an effect that a small amount of their addition can deposit a large amount of intermetallic compounds having high hardness. The deposition of intermetallic compounds increases the hardness of the aluminum alloy. The intermetallic compounds produced by Constituent B are deposited or crystallized out at grain boundaries of aluminum.

If the content of Constituent B is less than 0.1 wt. %, the above-mentioned effect cannot be obtained. If the content of Constituent B is more than 20 wt. %, although the hardness of the aluminum alloy increases, the ductility, critical upsetting ratio, and other properties deteriorate, reducing the forgeability.

The elements Mg and Li, which are used in Constituent C, have an effect that they can increase the hardness of the aluminum alloy when they are rapidly solidified in $\alpha$-aluminum to form a supersaturated solid solution. If the content of Constituent C is less than 0.1 wt. %, the above-mentioned effect cannot be obtained. If the content of Constituent C is more than 20 wt. %, although the hardness of the aluminum alloy increases, the ductility, critical upsetting ratio, and other properties deteriorate, reducing the forgeability.

When Constituents D, B, and C are added with the specified contents as shown above, because the aluminum having Constituent C as a solid solution has fine crystal grains and because the intermetallic compounds are deposited or crystallized out at grain boundaries, a structure is formed that has less tendency to overgrow with temperature. The formation of this structure enables the production of an aluminum alloy with superior balance between the hardness and forgeability.

If any one of Constituents D, B, and C lies beyond the specified range of content, the balance between the hardness and forgeability is destroyed, producing high hardness with low forgeability or high forgeability with low hardness.

In the aluminum alloy of the second aspect of the present invention, it is more desirable that the content of Constituent C be more than 5 wt. % and not more than 20 wt. %.

This content range, when the surface of the aluminum alloy is anodized to form an anodic oxide coating, enables the anodic oxide coating to obtain a shade of relatively low brightness such as brown or dark gray. The shade of the anodic oxide coating can be changed by adjusting the kind and content of elements used in Constituent C and other Constituents.

In the aluminum alloys of the first and second aspects of the present invention, it is more desirable that the aluminum alloys be further provided with an anodic oxide coating.

As mentioned above, the shade of an anodic oxide coating can be changed by adjusting the kind and content of elements used in the individual Constituents. This enables the production of aluminum alloys provided with anodic oxide coatings having different shades. As a result, the painting process of the product can be omitted by using an anodic oxide coating having relatively high hardness as the protective coating of the aluminum alloy and by adjusting the shade of the anodic oxide coating so as to conform to the shade required in the product using the aluminum alloy. Consequently, the manufacturing cost of the product using the aluminum alloy can be reduced.

In the aluminum alloys of the first and second aspects of the present invention, it is more desirable that the anodic oxide coating have a lightness less than 50.

The lightness is measured by spectrophotometric colorimetry using a chromaticity meter (Japanese Industrial Standard JIS Z 8729: the L*a*b* color-expressing system). The light source for the measurement is D65 (the International Lighting Committee: the ISO standard light) with a color temperature of 6,504K.

In the aluminum alloys of the first and second aspects of the present invention, the anodic oxide coating may be formed on the surface of an aluminum-alloy base material. In this case, the base material may have an electrical conductivity less than 20% IACS (International Annealed Copper Standard).

The present inventors have found that as the electrical conductivity of a base material decreases, the base-material element forms more solid solutions with the anodic oxide coating, giving a shade of relatively low brightness such as brown to the anodic oxide coating. The present inventors have also found that the base material requires to have an electrical conductivity less than 20% IACS in order to give a shade of relatively low brightness such as brown to the anodic oxide coating.

In the aluminum alloys of the first and second aspects of the present invention, the anodic oxide coating may have a shade of brown, dark gray, or dark brown.

When a component is required to have a low-bright shade such as brown in the final product, the use of the aluminum alloy of the present invention makes it possible to obtain the required shade by adjusting the kind and content of elements used in the individual Constituents. This simplifies the traditionally required painting process of the component. Consequently, the manufacturing cost of the component can be reduced.

The aluminum alloys of the first and second aspects of the present invention may have aluminum crystals and intermetallic compounds. In this case, the aluminum crystals may have an average grain diameter of 1,000 nm or less and the intermetallic compounds may have an average grain diameter of 500 nm or less.

This enables the aluminum alloy to obtain high forgeability without losing the high hardness.

If the aluminum crystals have an average grain diameter more than 1,000 nm or the intermetallic compounds have an average grain diameter more than 500 nm, although the aluminum alloy improves its forgeability by improving its ductility, critical upsetting ratio, and other properties, it decreases its hardness.

In the aluminum alloys of the first and second aspects of the present invention, it is more desirable that the aluminum crystals have an average grain diameter of 500 nm or less and that the intermetallic compounds have an average grain diameter of 300 nm or less.

This enables the aluminum alloy to obtain higher hardness without losing its forgeability such as ductility and critical upsetting ratio when higher hardness is required.

The aluminum alloys of the first and second aspects of the present invention may have a Rockwell B hardness ($H_{RB}$) not less than 50 and not more than 100. In this case, the aluminum alloy may have a critical upsetting ratio of 70% or more at temperatures not lower than 200° C. and not higher than 600° C. and an elongation of 10% or more at 20° C.

The hardness $H_{RB}$ not less than 50 and not more than 100 means sufficiently high hardness in comparison with the conventional ingot aluminum alloys such as A5052. This high hardness suppresses the generation of surface flaws during the manufacturing process, thereby significantly reducing the ratio of defective products due to the surface flaws. If the hardness $H_{RB}$ is less than 50, as in the conventional ingot aluminum alloys, it, is difficult to suppress the generation of surface flaws during the manufacturing process. If the hardness $H_{RB}$ is more than 100, such properties as the elongation at 20° C. and critical upsetting ratio deteriorate, reducing the forgeability.

The use of an aluminum alloy having the above-described critical upsetting ratio and elongation allows one or two processes of hot-working at temperatures not lower than 200° C. and not higher than 600° C., facilitating the near-net-shape forging of components with complicated shapes. If the aluminum alloy has a critical upsetting ratio less than 70% at temperatures not lower than 200° C. and not higher than 600° C. or an elongation less than 10% at room temperature (20° C.), one or two processes of hot-working (near-net-shape forging) for obtaining components with complicated shapes generates work cracking of the components during the forging.

It is more desirable that the aluminum alloy of the first aspect of the present invention comprises (1) not less than 1.5 wt. % and not more than 2.5 wt. % Constituent A, (2) not less than 3 wt. % and not more than 6 wt. % Constituent B, (3) not less than 4 wt. % and not more than 6 wt. % Constituent C, and (4) not less than 1 wt. % and not more than 1.5 wt. % Constituent D.

The above-mentioned selection of the content ranges of Constituents A, B, C, and D enables the aluminum alloy to obtain a more enhanced balance between the hardness and workability (forgeability).

It is more desirable that the aluminum alloy of the second aspect of the present invention comprises (1) not less than 1.5 wt. % and not more than 2.5 wt. % Constituent D, (2) not less than 3 wt. % and not more than 6 wt. % Constituent B, and (3) not less than 4 wt. % and not more than 6 wt. % Constituent C.

The above-mentioned selection of the content ranges of Constituents D, B, and C enables the aluminum alloy to obtain a more enhanced balance between the hardness and workability (forgeability).

The third aspect of the present invention offers a method for manufacturing an aluminum-alloy member made of the following aluminum alloy: The aluminum alloy comprises (1) not less than 0.1 wt. % and not more than 8 wt. % Constituent A comprising one or more kinds of elements selected from the group consisting of titanium (Ti), vanadium (V), hafnium (Hf), and zirconium (Zr), (2) not less than 0.1 wt. % and not more than 20 wt. % Constituent B comprising one or more kinds of elements selected from the group consisting of lanthanum (La), cerium (Ce), praseodymium (Pr), neodymium (Nd), mischmetal (Mm), calcium (Ca), strontium (St), and barium (Ba), and (3) not less than 0.1 wt. % and not more than 20 wt. % Constituent C comprising one or more kinds of elements selected from the group consisting of magnesium (Mg) and lithium (Li). First, a preform comprising the aluminum alloy is produced. Next, the preform is heated up to a temperature not lower than 200° C. and not higher than 600° C. at a temperature rising rate of not less than 2° C./sec and not more than 200° C./sec. Then, the heated preform is subjected to hot-working.

This procedure enables the easy production of an aluminum-alloy member having high hardness and a complicated shape notwithstanding the considerably reduced number of times of working during the hot-working process in comparison with the conventional methods.

If the temperature during the heating process (degasification process) of the preform is higher than 600° C. or the temperature-rising rate is less than 2° C./sec or more than 200° C./sec, the hot-working produces an aluminum alloy with sec or more than 200° C./sec, the hot-working produces an aluminum alloy with reduced hardness resulting from the coarsened grains of aluminum crystals and intermetallic compounds. If the heating temperature of the preform is lower than 200° C., it is difficult to give the preform sufficient strength because of the insufficient bonding between the grains constituting the preform. This reduces the critical upsetting ratio at temperatures not lower than 200° C. and not higher than 600° C. and an elongation at room temperature (20° C.), deteriorating the forgeability.

In the method for manufacturing an aluminum-alloy member in the third aspect of the present invention, the aluminum alloy may further comprise not less than 0.1 wt. % and not more than 5 wt. % Constituent D comprising one or more kinds of elements selected from the group consisting of niobium (Nb), molybdenum (Mo), silver (Ag), iron (Fe), cobalt (Co), tantalum (Ta), and tungsten (W).

The fourth aspect of the present invention offers a method for manufacturing an aluminum-alloy member made of the following aluminum alloy: The aluminum alloy comprises (1) not less than 0.1 wt. % and not more than 5 wt. % Constituent D comprising one or more kinds of elements selected from the group consisting of niobium (Nb), molybdenum (Mo), silver (Ag), iron (Fe), cobalt (Co), tantalum (Ta), and tungsten (W), (2) not less than 0.1 wt. % and not more than 20 wt. % Constituent B comprising one or more kinds of elements selected from the group consisting of lanthanum (La), cerium (Ce), praseodymium (Pr), neodymium (Nd), mischmetal (Mm), calcium (Ca), strontium (St), and barium (Ba), and (3) not less than 0.1 wt. % and not more than 20 wt. % Constituent C comprising one or more kinds of elements selected from the group consisting of magnesium (Mg) and lithium (Li). First, a preform comprising the aluminum alloy is produced. Next, the preform is heated up to a temperature not lower than 200° C. and not higher than 600° C. at a temperature rising rate of not less than 2° C./sec and not more than 200° C./sec. Then, the heated preform is subjected to hot-working.

This procedure enables the easy production of an aluminum-alloy member having high hardness and a complicated shape notwithstanding the considerably reduced number of times of working during the hot-working process in comparison with the conventional methods.

If the heating temperature of the preform is higher than 600° C. or the temperature-rising rate is less than 2° C./sec or more than 200° C./sec, the hot working produces an aluminum alloy with reduced hardness resulting from the coarsened grains of aluminum crystals and intermetallic compounds. If the heating temperature of the preform is lower than 200° C., the preform becomes brittle because of the insufficient bonding between the grains constituting the preform. This reduces the critical upsetting ratio at temperatures not lower than 200° C. and not higher than 600° C. and an elongation at room temperature (20° C.), deteriorating the forgeability.

In the methods for manufacturing aluminum-alloy members in the third and fourth aspects of the present invention, it is more desirable that the heating temperature of the preform be not lower than 350° C. and not higher than 450° C.

The above-mentioned selection of the heating temperature enables the aluminum-alloy member to easily obtain a more enhanced balance between the hardness and forgeability.

In the methods for manufacturing aluminum-alloy members in the third and fourth aspects of the present invention, it is desirable that the die temperature for the hot-working be about 400° C.

In the methods for manufacturing aluminum-alloy members in the third and fourth aspects of the present invention, the step for producing the preform may include a step for forming rapidly solidified powders of aluminum alloy.

In the methods for manufacturing aluminum-alloy members in the third and fourth aspects of the present invention, the step for producing the preform may employ the OSPREY method.

In the methods for manufacturing aluminum-alloy members in the third and fourth aspects of the present invention, the step for producing the preform may include a step for forming powders produced by pulverizing rapidly solidified ribbons of aluminum alloy.

PREFERRED EMBODIMENTS OF THE INVENTION

The following is an explanation of the preferred embodiments of the present invention.

Embodiment 1

Aluminum-alloy powders having a composition shown in the columns for Experimental Examples 1 to 11 in Table 1 were produced by using a gasatomization device. In the gas-atomization method, a nitrogen gas was blown onto a molten aluminum alloy dropping from a nozzle having a hole 2 mm in diameter. The nitrogen gas was pressurized at 100 kgf/cm$^2$. In this case, air or an inert gas such as argon may be used in place of the nitrogen gas.

Powders of a 2014 aluminum alloy were also produced under the same condition of gas atomization as described above. The spacing between dendrite arms in the powder structure of the 2014 aluminum alloy was measured to estimate the cooling rate in the foregoing process. The result demonstrates that the production of powders having a particle diameter of 150 $\mu$m corresponds to a cooling rate of $1.0\times10^{3}$° C./sec.

The aluminum-alloy powders were sieved out to obtain powders having a diameter less than 150 $\mu$m. The obtained aluminum-alloy powders were press-formed to produce preforms. The preforms were heated up to temperatures of 350 to 400° C. at a temperature rising rate more than 2° C./sec, actually at 10° C./sec, as shown in Table 1 as the heating and degasifying treatments.

Subsequently, the preforms were inserted into a die kept at 400° C. to solidify the powders under a surface pressure of 9 t/cm$^2$. The fine structure and mechanical properties of the obtained solidified bodies were examined. The results are shown in Tables 1 and 2.

The grain diameters shown in Table 1 were determined by the following method: First, a section of a solidified body was mirror polished. Second, micrographs of the fine structure were taken by using a high-resolution scanning electron microscope (SEM) at 50,000 power. Finally, the individual micrographs were input into a personal computer to process the pictures for measuring the grain diameters of the aluminum crystals and intermetallic compounds. Because the aluminum crystals and intermetallic compounds have a different contrast on the micrograph, they are easily distinguished. The grain diameters were measured on three visual fields of each Experimental Example. Table 1 shows the average value of the measured results.

TABLE 1

| Powder-solidified body | Composition (wt. %) | Preform-heating condition: Ultimate temperature (° C.) | Preform-heating condition: Temperature-rising rate (° C./sec) | Grain diameter of aluminum crystals (nm) | Grain diameter of intermetallic compounds (nm) |
|---|---|---|---|---|---|
| 1 | Al—2 Zr—8 Mm—18 Mg | 400 | 10 | 600 | 300 |
| 2 | Al—3 Zr—8 Mm—10 Mg | 400 | 10 | 500 | 200 |
| 3 | Al—2 Ti—4.5 Mm—9 Mg | 350 | 10 | 500 | 200 |
| 4 | Al—2 Mo—3 Mm—11 Mg | 400 | 10 | 650 | 400 |
| 5 | Al—5 V—2 Nb—3 Mm—8 Mg | 350 | 10 | 700 | 300 |
| 6 | Al—6 Zr—3 Mm—2 Ta—6 Mg | 400 | 10 | 850 | 400 |
| 7 | Al—2 Zr—8 Mm—8 Mg | 400 | 10 | 500 | 300 |
| 8 | Al—2 Zr—8 Mm—16 Mg | 400 | 10 | 500 | 300 |
| 9 | Al—3 Zr—4.5 Mm—8 Mg | 400 | 10 | 500 | 300 |
| 10 | Al—2 Zr—8 Mm—8 Mg—3 Mo | 400 | 10 | 500 | 300 |
| 11 | Al—2 Zr—8 Mm—8 Mg—3 Ta | 400 | 10 | 500 | 300 |
| 12 | Al—2 Zr—8 Mm—16 Mg | 400 | 0.5 | 1,200 | 700 |
| 13 | | 180 | 10 | 300 | 200 |
| 14 | | 650 | 10 | 2,000 | 600 |
| 15 | Al—2 Zr—8 Mm—25 Mg | 400 | 10 | 600 | 200 |
| 16 | Al—10 Zr—8 Mm—8 Mg | 400 | 10 | 600 | 600 |
| 17 | Al—3 Zr—21 Mm—6 Mg | 400 | 10 | 500 | 750 |
| 18 | Al—2 Zr—3 Mm—6 Mg—10 Mo | 400 | 10 | 700 | 900 |
| 19 | Al—10 Ti—6 Mm—10 Mg—8 Nb | 400 | 10 | 600 | 800 |

TABLE 2

| Powder-solidified body | Room-temperature hardness $H_{RB}$ | Room-temperature elongation (%) | Upsetting temperature (° C.) | Critical upsetting ratio (%) | Shade of alumite | Electrical conductivity (% IACS) | Lightness of alumite L* |
|---|---|---|---|---|---|---|---|
| 1 | 91 | 10 | 400 | 81 | Brown | 12.6 | 22.5 |
| 2 | 94 | 10 | 400 | 75 | Dark gray | 13.0 | 23.6 |
| 3 | 95 | 15 | 300 | 80 | Brown | 12.0 | 21.5 |
| 4 | 91 | 11 | 600 | 85 | Dark gray | 16.0 | 33.5 |
| 5 | 89 | 13 | 300 | 75 | Dark gray | 17.0 | 30.5 |
| 6 | 95 | 11 | 400 | 80 | Dark gray | 9.0 | 20.5 |
| 7 | 84 | 11 | 400 | 88 | Dark gray | 18.2 | 45.8 |
| 8 | 91 | 10 | 400 | 81 | Brown | 15.2 | 43.1 |
| 9 | 82 | 10 | 400 | 71 | Brown | 17.3 | 47.5 |
| 10 | 78 | 13 | 400 | 86 | Dark gray | 14.2 | 36.9 |
| 11 | 81 | 12 | 400 | 81 | Dark gray | 11.6 | 33.2 |
| 12 | 49 | 18 | 400 | 90 | Light gray | 25.0 | 63.9 |
| 13 | 103 | 0 | 400 | 50 | Dark gray | 10.5 | 31.8 |
| 14 | 46 | 21 | 400 | 95 | Light gray | 24.0 | 65.1 |
| 15 | 110 | 0 | 400 | 45 | Dark gray | 10.0 | 21.6 |
| 16 | 85 | 5 | 400 | 65 | Dark gray | 18.0 | 28.4 |
| 17 | 91 | 3 | 400 | 67 | Dark gray | 15.0 | 27.3 |
| 18 | 91 | 8 | 500 | 68 | Dark gray | 12.0 | 32.4 |
| 19 | 92 | 6 | 500 | 71 | Dark brown | 14.0 | 26.5 |

The fine structures of the solidified bodies of Experimental Examples 1 to 11 were examined by the above-described method.

As is seen in Table 1, it was confirmed that all the Experimental Examples 1 to 11 have both aluminum crystals and intermetallic compounds. It was also confirmed that all the Experimental Examples 1 to 11 have aluminum crystals less than 1,000 nm in grain diameter and intermetallic compounds less than 500 nm in grain diameter.

Next, aluminum-alloy powders having a composition shown in the columns for Experimental Examples 12 to 19 in Table 1 were produced by a method similar to that used for Experimental Examples 1 to 11. Experimental Examples 12 to 19 were produced by using these powders. The heating conditions for the preforms of Experimental Examples 12 to 19 are also shown in Table 1. The fine structures of Experimental Examples 12 to 19 were also examined by the same method as in Experimental Examples 1 to 11.

The following measurements were carried out on Experimental Examples 1 to 19 shown in Table 1: hardness $H_{RB}$ at room temperature (20° C.), tensile strength at room temperature, critical upsetting ratio, and the shade of an anodic oxide coating (alumite) and other properties when the anodic oxide coating was formed on the surface.

As shown in Table 2, all the Experimental Examples 1 to 11 have a room-temperature hardness $H_{RB}$ more than 50 and less than 100, an elongation not less than 10%, and a critical upsetting ratio more than 70%.

The surfaces of the solid bodies of Experimental Examples 1 to 11 were anodized to form an anodic oxide coating (alumite). The shade of the alumite was examined. As is seen in Table 2, the results showed that all the Experimental Examples 1 to 11 have a dark shade such as brown or dark gray. The lightness of the alumite was measured; the result showed that all the Experimental Examples 1 to 11 have a lightness less than 50. The electrical conductivity of the matrices of the solidified bodies of Experimental Examples 1 to 19 was measured. As is seen in Table 2, the result showed that when the electrical conductivity is less than 20% IACS, the shade of the alumite is dark (less than 50 in lightness) such as brown. Incidentally, all the Experimental Examples 1 to 11 have an electrical conductivity less than 20% IACS.

The fine structures and mechanical properties of Experimental Examples 12 to 19 are discussed in the following:

Experimental Example 12 has a room-temperature hardness as low as. 49, as is seen in Table 2. This is attributable to the grain diameter of the aluminum crystals as large as 1,200 nm resulting from the temperature-rising rate as low as 0.5° C./sec in the preform-heating conditions as can be seen in Table 1. If the room-temperature hardness is less than 50, surface flaws and other defects tend to be generated during the manufacturing process, causing a yield reduction as in the conventional products.

Experimental Example 13, although having a room-temperature hardness exceeding 100, has practically no elongation and a critical upsetting ratio as low as 50%. This is attributable to the fact that the ultimate temperature was 180° C. in the preform-heating conditions, i.e., the preform was not heated up to a temperature exceeding 200° C.

Experimental Example 14 also has a room-temperature hardness as low as 46, as is seen in Table 2. This is attributable to the grain diameter of the aluminum crystals as large as 2,000 nm, which is more than necessary, resulting from the ultimate temperature as high as 650° C. in the preform-heating conditions as can be seen in Table 1.

Experimental Example 15 contains, in its composition, more Mg than the content specified for the aluminum alloy of the present invention as is seen in Table 1. Consequently, as shown in Table 2, although sufficiently high in room-temperature hardness, Experimental Example 15 has low elongation and critical upsetting ratio, and hence low forgeability.

Experimental Example 16 contains more Zr than the content specified for the aluminum alloy of the present invention as is seen in Table 1. Consequently, as shown in Table 2, although sufficiently high in room-temperature hardness, Experimental Example 16 has low elongation and critical upsetting ratio.

Experimental Example 17 contains more Mm than the content specified for the aluminum alloy of the present invention as is seen in Table 1. Consequently, as shown in Table 2, although sufficiently high in room-temperature hardness, Experimental Example 17 has low elongation and critical upsetting ratio.

Experimental Example 18 contains more Mo than the content specified for the aluminum alloy of the present invention as is seen in Table 1. Consequently, as shown in Table 2, although sufficiently high in room-temperature hardness, Experimental Example 18 has low elongation and critical upsetting ratio.

Experimental Example 19 contains more Ti and Nb than the contents specified for the aluminum alloy of the present invention as is seen in Table 1. Consequently, as shown in Table 2, although sufficiently high in room-temperature hardness, Experimental Example 19 has low elongation.

The anodizing was carried out by the following process: First, the surface of a solidified body was cut. Second, the solidified body subjected to the cutting work was cleaned by caustic soda. Finally, anodizing was conducted up to a coating thickness of about 10$\mu$m.

The structure in the vicinity of the boundary between the anodic oxide coating and base material (matrix) was examined on the individual Experimental Examples 1 to 19 by using a high-resolution scanning electron microscope. The result was that the reflected electron image of the structure demonstrates the existence of intermetallic compounds in the anodic oxide coating. When the shade of an anodic oxide coating (alumite) becomes brown or dark gray, the alumite has an increased amount of the intermetallic compounds to a certain extent. More specifically, the intermetallic compounds occupy more than 20% of the area of the alumite.

It was also confirmed that when a sample made of the aluminum alloy of the present invention is upset at high temperature and then its surface is polished by buffing or another simple means, the surface of the sample can easily obtain metallic luster.

Embodiment 2

Aluminum-alloy powders having a composition shown in the columns for Experimental Examples 20 to 27 in Table 3 were produced by a method similar to that used for Embodiment 1 of the present invention. Experimental Examples 20 to 27 were produced by using these powders. Samples of solidified bodies were formed by a method basically similar to that used for Embodiment 1 of the present. invention. The heating conditions for the preforms are shown in Table 3. The fine structures and mechanical properties of the solidified bodies were examined by a method similar to that used for Embodiment 1 of the present invention. The results are shown in Tables 3 and 4.

TABLE 3

| | | Preform-heating condition | | | |
|---|---|---|---|---|---|
| Powder-solidified body | Composition (wt. %) | Ultimate temperature (° C.) | Temperature-rising rate (° C./sec) | Grain diameter of aluminum crystals (nm) | Grain diameter of intermetallic compounds (nm) |
| 20 | Al—2 Mo—3 Mm—3 Mg | 400 | 10 | 650 | 400 |
| 21 | Al—1 V—1 Nb—3 Mm—3 Mg | 350 | 10 | 700 | 300 |
| 22 | Al—3 Ti—13 Mm—3 Mg | 400 | 10 | 400 | 300 |
| 23 | Al—1 Hf—5 Mm—3 Mg | 400 | 10 | 500 | 300 |
| 24 | Al—3 Ag—13 Mm—2 Mg | 400 | 10 | 400 | 250 |

TABLE 3-continued

| Powder-solidified body | Composition (wt. %) | Preform-heating condition: Ultimate temperature (° C.) | Temperature-rising rate (° C./sec) | Grain diameter of aluminum crystals (nm) | Grain diameter of intermetallic compounds (nm) |
|---|---|---|---|---|---|
| 25 | Al—2 V—9 Mm—2 Mg—3 Mo | 350 | 10 | 500 | 300 |
| 26 | Al—2 V—9 Mm—2 Mg—3 W | 400 | 10 | 500 | 300 |
| 27 | Al—3 Zr—13.5 Mm—2 Li | 400 | 10 | 400 | 500 |
| 28 | Al—2 Mo—3 Mm—3 Mg | 400 | 0.5 | 1,200 | 600 |
| 29 | | 180 | 10 | 500 | 300 |
| 30 | | 650 | 10 | 2,000 | 700 |
| 31 | Al—2 Mo—8 Mm—25 Mg | 400 | 10 | 500 | 200 |
| 32 | Al—5 Ti—5 V—8 Mm—8 Mg | 400 | 10 | 600 | 600 |
| 33 | Al—3 Zr—10 Mm—11 La—6 Mg | 400 | 10 | 500 | 1,000 |
| 34 | Al—10 Mo—3 Mm—3 Mg | 400 | 10 | 1,000 | 800 |
| 35 | Al—10 W—2 Mm—4 Mg | 400 | 10 | 1,200 | 900 |

TABLE 4

| Powder-solidified body | Room-temperature hardness $H_{RB}$ | Room-temperature elongation (%) | Upsetting temperature (° C.) | Critical upsetting ratio (%) | Shade of alumite | Electrical conductivity (% IACS) | Lightness of alumite L* |
|---|---|---|---|---|---|---|---|
| 20 | 88 | 11 | 500 | 65 | Light gray | 24.3 | 65.2 |
| 21 | 78 | 13 | 300 | 76 | Light gray | 26.8 | 69.8 |
| 22 | 74 | 13 | 400 | 81 | Light yellow | 26.5 | 68.2 |
| 23 | 73 | 20 | 400 | 92 | Light yellow | 24.0 | 61.4 |
| 24 | 84 | 14 | 400 | 85 | Light yellow | 24.5 | 59.8 |
| 25 | 88 | 12 | 500 | 92 | Light gray | 20.0 | 68.3 |
| 26 | 87 | 11 | 500 | 85 | Light gray | 21.8 | 69.2 |
| 27 | 85 | 10 | 400 | 79 | Dark gray | 18.9 | 36.3 |
| 28 | 44 | 25 | 400 | 90 | Light gray | 30.0 | 60.2 |
| 29 | 101 | 2 | 400 | 50 | Dark gray | 10.6 | 20.4 |
| 30 | 48 | 22 | 400 | 95 | Light gray | 32.0 | 59.8 |
| 31 | 112 | 0 | 400 | 45 | Dark gray | 9.0 | 15.8 |
| 32 | 91 | 3 | 400 | 55 | Dark gray | 11.0 | 20.6 |
| 33 | 91 | 1 | 400 | 45 | Dark gray | 8.0 | 17.8 |
| 34 | 81 | 7 | 400 | 80 | Dark gray | 18.6 | 45.6 |
| 35 | 82 | 8 | 400 | 76 | Dark gray | 19.2 | 48.9 |

As is seen in Tables 3 and 4, the measured items for Experimental Examples 20 to 27 are the same as those for Embodiment 1 of the present invention. The measured results for all the items of Experimental Examples 20 to 27 are within the range specified for the aluminum alloy of the present invention. The surfaces of the samples were anodized similarly to Embodiment 1 of the present invention to form an anodic oxide coating (alumite). The shade and lightness of the alumite were examined. The electrical conductivity of the base material was also measured. As can be seen in Tables 3 and 4, the shade of the aluminum alloy can be changed to one such as dark gray or light yellow by adjusting the composition of the aluminum alloy.

Aluminum-alloy powders having a composition shown in the columns for Experimental Examples 28 to 35 in Table 3 were produced similarly to Experimental Examples 20 to 27. The powders were used to produce solidified bodies under the heating conditions for the preforms shown in Table 3. The fine structures and mechanical properties of the solidified bodies were examined similarly to Experimental Examples 20 to 27.

Experimental Example 28 was prepared by a temperature-rising rate lower than 2° C./sec. Experimental Example 30 was prepared at an ultimate temperature higher than 600° C. As a result, Experimental Examples 28 and 30 have aluminum-crystal grains and intermetallic compounds both larger in diameter than the values desirable for the aluminum alloy of the present invention. Consequently, both Examples have a considerably low room-temperature hardness as shown in Table 4.

Experimental Example 29 was prepared at an ultimate temperature lower than 200° C. Consequently, although high in room-temperature hardness, Experimental Example 29 has low elongation and critical upsetting ratio.

Experimental Example 31 contains Constituent C of which Mg exceeds 20 wt. % in content. Consequently, although sufficiently high in room-temperature hardness, Experimental Example 31 has considerably low elongation and critical upsetting ratio.

Experimental Example 32 contains Constituent A of which the sum of Ti and V exceeds 8 wt. % in content. As a result, Experimental Example 32 has intermetallic compounds not only increased in the amount of deposition but also excessively grown. Consequently, although, sufficiently high in room-temperature hardness, Experimental Example 32 has considerably low elongation and critical upsetting ratio.

Experimental Example 33 contains Constituent B of which the sum of Mm and La exceeds 20 wt. % in content. As a result, Experimental Example 33 also has intermetallic compounds not only increased in the amount of deposition but also excessively grown. Consequently, although sufficiently high in room-temperature hardness, Experimental Example 33 has considerably low elongation and critical upsetting ratio.

Experimental Example 34 contains more Mo than 5 wt. %. In this case also, the intermetallic compounds are excessively grown. Consequently, although the room-temperature hardness becomes high, the elongation decreases.

Experimental Example 35 contains more W than 5 wt. %. In this case also, the intermetallic compounds are not only increased in the amount of deposition but also excessively grown. Consequently, although the room-temperature hardness increases to a certain extent, the elongation decreases.

As described above, the aluminum alloy of the present invention has high hardness and good elongation and critical upsetting ratio (forgeability). It is also possible to obtain a member having metal luster by giving it simple polishing after hot-working.

Because the shade of the alumite can be changed by adjusting additive elements, a highly hard anodic oxide coating can be used not only as a protective coating but also as a colored layer that gives necessary coloring.

The aluminum alloy of the present invention can be used both as an exterior component of electronic devices, for example, and as a component of household electrical appliances, ornamental objects, cars, and other objects.

The present embodiments are to be considered in all respects as illustrative and not restrictive. The scope of the present invention is indicated by the appended claims rather than by the above-described embodiments. All changes that come within the meaning and range of equivalency of the claims are therefore intended to be embraced by the claims.

What is claimed is:

1. An aluminum alloy comprising:

(1) not less than 1 wt. % and not more than 6 wt. % Constituent A comprising one or more elements selected from the group consisting of titanium, vanadium, hafnium, and zirconium, (2) not less than 3 wt. % and not more than 13.5 wt. % Constituent B comprising one or more elements selected from the group consisting of lanthanum, cerium, praseodymium, neodynium, mischmetal, calcium, strontium, and barioum, and (3) not less than 2 wt. % and not more than 18 wt. % Constituent C comprising one or more elements selected from the group consisting of magnesium and lithium, wherein: the aluminum alloy has been fabricated by initially forming a preform containing Constituents A, B and C, and heating the preform up to a temperature not lower than 200° C. and not higher than 600° C. at a temperature rising rate of not less than 2° C./sec and not more than 200° C./sec; the step of producing the preform includes a step of forming rapidly solidified powders of the aluminum alloy;

the aluminum alloy contains aluminum crystals and intermetallic compounds, the aluminum crystals have an average grain diameter of 1,000 nm or less, and the intermetallic compound has an average grain diameter of 500 nm or less; and the aluminum alloy has a hardness $H_{RB}$ not less than 50 and not more than 100, a critical upsetting ratio of 70% or more at temperatures not lower than 200° C. and an elongation of 10% or more at 20° C.

2. An aluminum alloy as defined in claim 1, the aluminum alloy further comprising not less than 1 wt. % and not more than 3 wt. % Constituent D comprising one or more elements selected from the group consisting of niobium, molybdenum, silver, iron, tantalum, and tungsten.

3. An aluminum alloy as defined in claim 1, the aluminum alloy being further provided with an anodic oxide coating.

4. An aluminum alloy as defined in claim 3, wherein the anodic oxide coating has a lightness less than 50.

5. An aluminum alloy as defined in claim 4, wherein:

the anodic oxide coating is formed on the surface of a base material made of the aluminum alloy, and the base material has an electrical conductivity less than 20% IACS.

6. An aluminum alloy as defined in claim 4, wherein the anodic oxide coating is a shade of brown, dark gray, or dark brown.

7. An aluminum alloy as defined in claim 1, wherein the aluminum crystals have an average grain diameter of 500 nm or less and the intermetallic compounds have an average grain diameter of 300 nm or less.

8. A method for manufacturing an aluminum-alloy member according to claim 1, the method comprising the steps of:

(1) producing a preform:

(2) heating the preform up to a temperature not lower than 200° C. and not higher than 600° C. at a temperature rising rate of not less than 2°C./sec and not more than 200° C./sec; and (3) subjecting the heated preform to hot-working.

9. A method for manufacturing an aluminum-alloy member as defined in claim 8, wherein the aluminum alloy further comprises not less than 0.1 wt. % and not more than 5 wt. % Constituent D comprising one or more kinds of elements selected from the group consisting of niobium, molybdenum, silver, iron, cobalt, tantalum, and tungsten.

10. A method for manufacturing an aluminum-alloy member as defined in claim 8, wherein the step of producing the preform includes a step of forming rapidly solidified powders of the aluminum alloy.

11. A method for manufacturing an aluminum-alloy member as defined in claim 8, wherein the step of producing the preform employs the OSPREY method.

12. A method for manufacturing an aluminum-alloy member as defined in claim 8, wherein the step of producing the preform includes a step of forming powders produced by pulverizing rapidly solidified ribbons of the aluminum alloy.

* * * * *